US005993204A

United States Patent [19]

Stubbs

[11] Patent Number: 5,993,204

[45] Date of Patent: Nov. 30, 1999

[54] DENTAL TOOL FOR ANIMALS

[76] Inventor: R. Clay Stubbs, HC3 Box 38, Johnson City, Tex. 78636

[21] Appl. No.: 09/236,209

[22] Filed: Jan. 23, 1999

[51] Int. Cl.[6] ..... A61D 5/00

[52] U.S. Cl. ..... 433/1

[58] Field of Search ..... 433/1

[56] References Cited

U.S. PATENT DOCUMENTS

| | | | |
|---|---|---|---|
| 792,666 | 6/1905 | Reed et al. | 433/1 |
| 5,888,064 | 3/1999 | Stubbs | 433/1 |

*Primary Examiner*—John J. Wilson
*Attorney, Agent, or Firm*—Ted Masters

[57] ABSTRACT

A dental rasp for animals (20) includes an elongated shaft (22) to which is attached a circular rasp (28). Dental rasp (20) is attached to a reciprocating mechanism (504) which causes rasp (28) to longitudinally oscillate. In a preferred embodiment rasp (28) has a diameter of about one inch. Rasp (28) has a plurality of teeth (32) which are oriented to file on the reverse stroke of the of the reciprocating mechanism (504). Rasp (28) is planar and defines an angle A with shaft (22). In a preferred embodiment angle A ranges between 135° and 180°.

8 Claims, 4 Drawing Sheets

DENTAL TOOL FOR ANIMALS

TECHNICAL FIELD

The present invention pertains to dental tools for use on animals such as members of the equine species, and more particularly to rasps for removing over length tooth crowns and sharp edges.

BACKGROUND ART

The teeth of the equine species continuously grow, and as such it is necessary to periodically file off overgrown surfaces and sharp projecting edges. The filing process is also known as rasping or "floating". Absent this periodic treatment, the animal's teeth will grow to a point where it can experience difficulty in chewing, or can develop tooth induced ulcerations of the soft mouth tissue and tongue. Devices to file a horse's teeth are well known in the art. They range from hand-held floats and rasps, to rasps mounted upon both reciprocating and rotary power tools. For example, U.S. Pat. No. 579,966 shows a veterinary file holder. Two lips or flanges are secured to a wire member, forming salient edges which overlap the edges of a file. U.S. Pat. No. 5,533,894 defines an equine dental float which includes a handle with a head at one end. The head has a trough-like structure with a plurality of individual teeth mounted in the trough. A pin mounted through an aperture in each of the plurality of teeth aligns the teeth and removably connects the teeth within the trough. Each tooth is polygon in shape and has a plurality of cutting edges, with one of the cutting edges of each tooth projecting upwardly out of the trough to form a filing surface. German Patent 26 37 915 depicts a tool for filing horse teeth having a reciprocating rasp in a U/rail supported by a rod connected to a drive housing. The joint between the rod and the housing is formed by a plate attached to the end of the rod and covering the housing interior and the drive mechanism. The tool can be handled more safely and allows rapid filing down of teeth without insertion of a lock in the horse's mouth. German Patent 30 02 386 comprises a teeth grinding instrument intended for the molars of horses having a motor-driven grindstone. The grindstone is coupled by a chuck to a compressed air motor. The device also has one or more air outlet ports, together with a water pipe spraying onto the grinding area, and one or more fiber optic light sources. French Patent 1.052.653 describes a rotary grinding device for animal dentistry. Mikita Model 4399D and 4399DW discloses a Cordless Equine Rasp. This device operates an 2,700 strokes per minute, has a 5/32 inch stroke, and weighs 5.3 lbs. Rotary motion provided by an electric is mechanically converted to reciprocating motion. The tool is marketed by the Mikita Corp. 3-11-8, Sumiyoshi-cho, Anjo, Aichi 446 Japan. EQUI-DENT Technologies, Inc., P.O. Box 5877, Sparks NV 89432-5877 (702) 358-6695, also markets an electrically powered reciprocating rasp for horses which operates at 1,200 oscillations per minute, has a 1 and 3/16 inch stroke, and weighs approximately 7.4 lbs. Mikita Model TR 3000V reciprocating saw forms the basis for the EQUI-DENT rasp.

DISCLOSURE OF INVENTION

The present invention is directed to an improved dental tool for animals. The tool comprises an elongated shaft onto one end of which is added a circular rasp. The tool is installed, much as is a drill bit, into a reciprocating mechanism and is used to file down (float or rasp) the teeth of horses or other members of the equine family. The reciprocating mechanism causes the tool and attached rasp to longitudinally oscillate back and forth making filing of the teeth possible. The benefit of the present invention resides in the circular shape of the rasp. Conventional rasps typically have an elongated shape with rounded comers. Due to the elongated shape, the conventional rasp moves a greater distance and files a larger area than does the present invention. One particularly disagreeable feature of the conventional rasp is the fact that as the filing operation moves toward the end of the elongated rasp, vibration can set in and reduce filing effectiveness.

By virtue of its circular shape, the present invention focuses or concentrates the filing in a small area. In so doing the rasp of the present invention does not move as far, is more controllable, and the possibility of damaging the soft mouth tissue or bone of the animal is substantially reduced. Other advantages of the present invention include less vibration due to (1) a smaller filing area, and (2) the closer proximity of the rasp to the shaft, and less weight which increases the oscillatory speed of the device.

In accordance with a preferred embodiment of the invention, a dental tool for animals comprises an elongated shaft having a first end and an opposite second end. A planar substantially circular rasp surface is connected to the first end.

In accordance with an important aspect of the invention, the rasp has a diameter of about one inch.

In accordance with an important feature of the invention, a substantially circular holder is connected to the first end of the shaft, and the rasp is fitted into the holder.

In accordance with another important aspect of the invention, the rasp includes a plurality of teeth which are pointed toward the second end of the elongated shaft. The rasp defines a plane which for different dental tools forms a different angle A of between substantially 135° and 180° with the elongated shaft. In practice, angles A of between substantially 150° and 180° are most useful.

In accordance with another important feature of the invention, the rasp includes a plurality of teeth which are pointed away from the second end of the elongated shaft. The rasp defines a plane which for different dental tools forms a different angle B of between substantially 180° and 225° with the elongated shaft. In practice, angles B of between substantially 180° and 210° are most useful.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
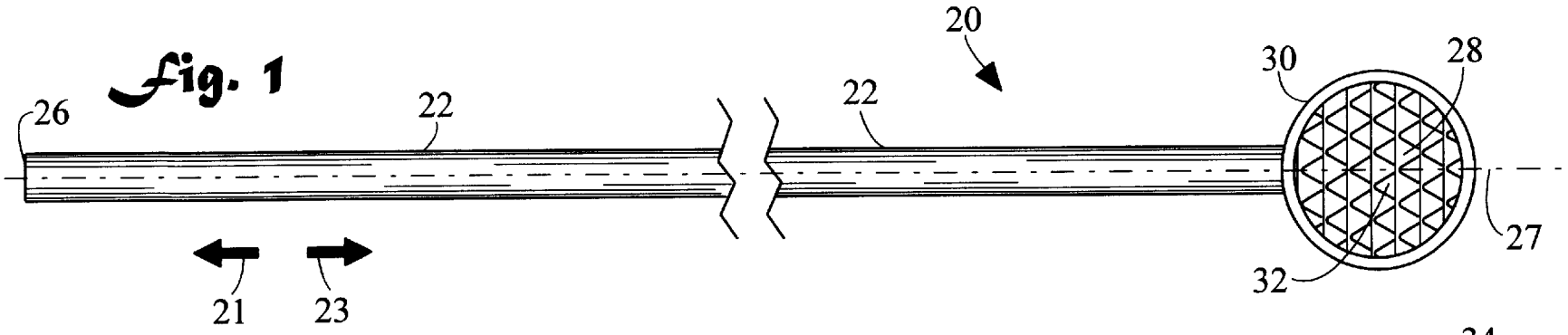
FIG. 1 is a fragmented top plan view of a dental tool in accordance with the present invention.
Figure 2:
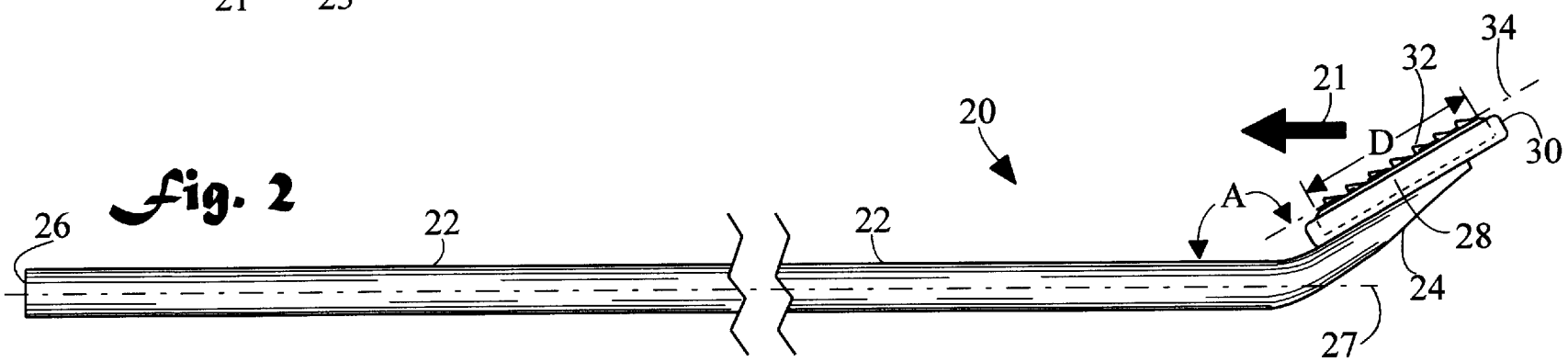
FIG. 2 is a fragmented side view of the tool.
Figure 3:
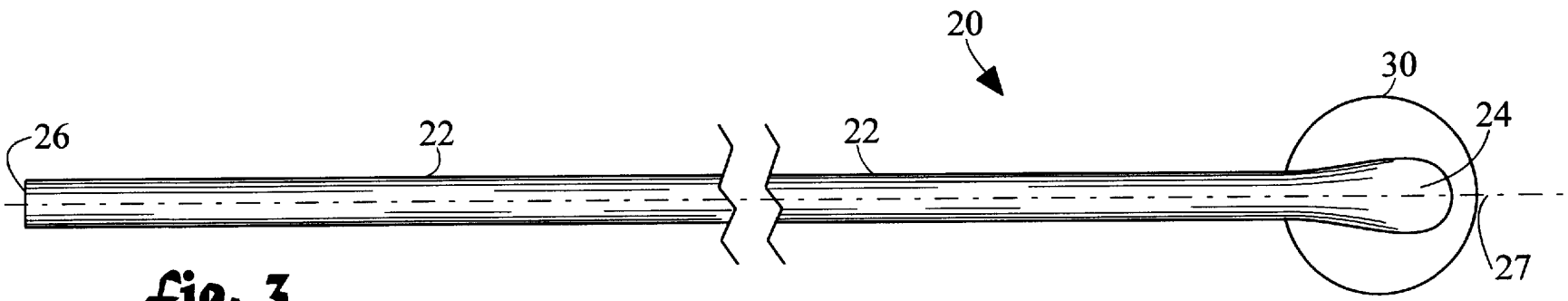
FIG. 3 is a fragmented bottom elevation view of the tool.

Referring initially to FIGS. 1–3, there are illustrated fragmented top plan, side elevation, and bottom elevation views respectively of a dental tool for animals such as the equine species in accordance with the present invention, generally designated as 20. Dental tool 20 includes an elongated shaft 22 having a first end 24, an opposite second end 26, and a longitudinal axis 27. In a preferred embodiment, elongated shaft 22 has a length of about 12 inches. Second end 26 is connected to a reciprocating mechanism 504 (refer to FIG. 11) which causes elongated shaft to rapidly oscillate back and forth in directions 21 and 23. A planar substantially circular rasp 28, fabricated from carbide or some other hard material, is connected to first end 24. The surface of rasp 28 is substantially planar as opposed to being curved or cylindrical. Rasp 28 is connected to (received by) a substantially circular holder 30, which is connected to first end 24. In a preferred embodiment for standard size horses, rasp 28 has a diameter D of about one inch. Diameter D can be increased or decreased to accommodate large and small size animals respectively.

Rasp 28 includes a plurality of teeth 32. In the shown embodiment, teeth 32 point toward second end 26 of elongated shaft 22 so that filing occurs when elongated shaft 22 moves on the reverse stroke in direction 21. Rasp 28 defines a plane 34 which forms an angle A of between substantially 135° and 180° with elongated shaft 22. Dental tools 20 having different angles A are specifically designed to file different teeth. For example, an angle A of 150° is useful in filing the back side of rear teeth (refer to FIG. 2). In a preferred embodiment, angle A is between substantially 150° and 180°. In practice to properly rasp all of the teeth of an animal, more than one rasp angle A is necessary. Therefore, several dental tools 20 having different rasp angles A are provided. One preferred combination of dental tools 20 have rasp angles A of 178°, 155°, and 150°.

Figure 4:
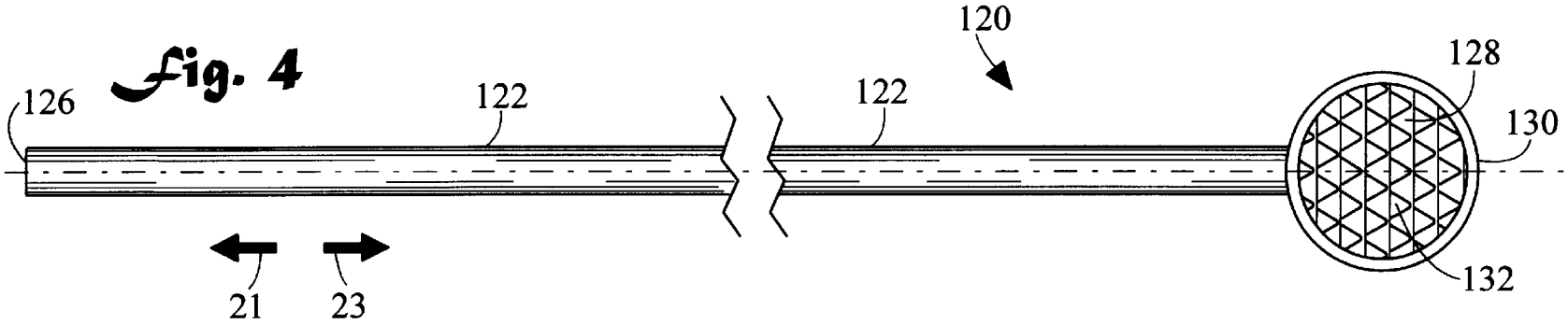
FIG. 4 is a fragmented top plan view of a second embodiment.
Figure 5:
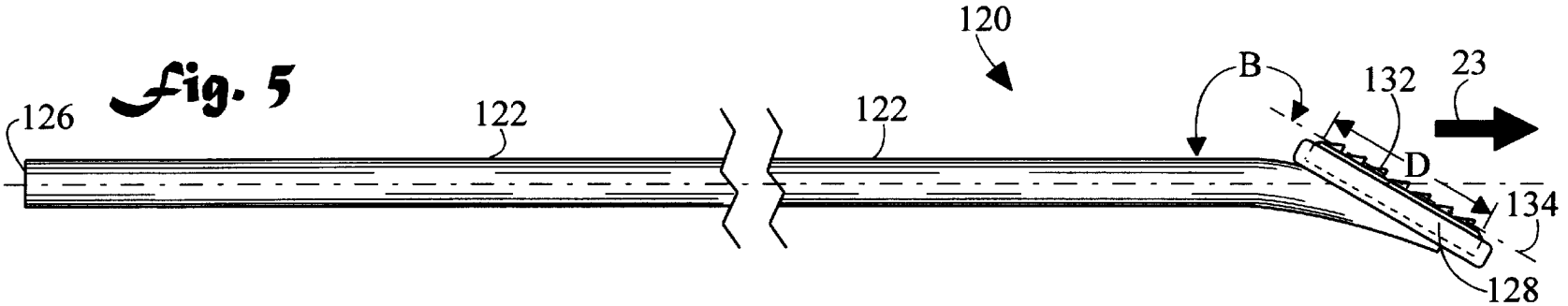
FIG. 5 is a fragmented side elevation view of the tool of FIG. 4.
Figure 6:
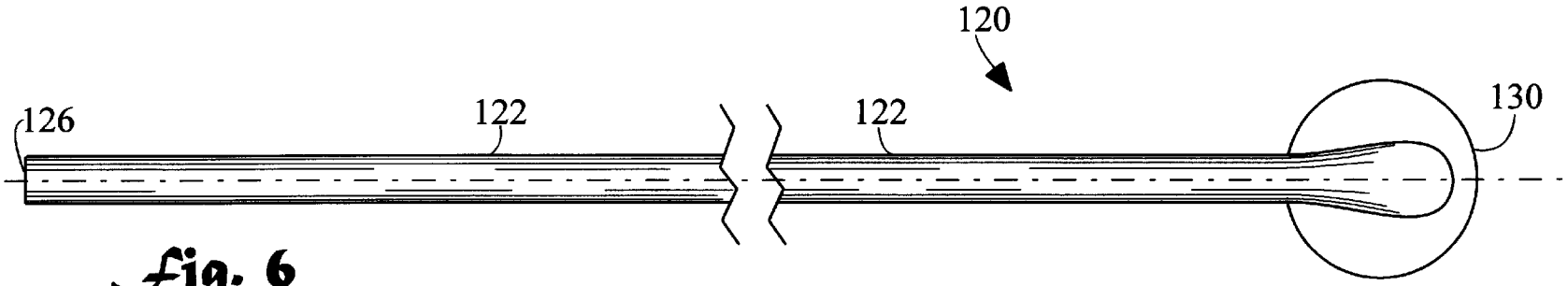
FIG. 6 is a fragmented side elevation view of the tool of FIG. 4.

Now referring to FIGS. 4–6, there are illustrated fragmented top plan, side elevation, and bottom elevation views respectively of a second embodiment of a dental tool in accordance with the present invention, generally designated as 120. Dental tool 120 is similar to dental tool 20 with the exception that dental tool 120 is designed to file on the forward stroke in direction 23. Rasp 128 includes a plurality of teeth 132 which pointed away from second end 126 of elongated shaft 122. Rasp 128 defines a plane 134 which forms an angle B of between substantially 180° and 225° with elongated shaft 122. In a preferred embodiment, angle B is between substantially 180° and 210° (210° is shown in FIG. 5. As in dental tool 20, in practice to properly rasp all of the teeth of an animal, more than one rasp angle B is necessary. Therefore, several dental tools 120 having different rasp angles B are provided. One preferred combination of dental tools 120 have rasp angles B of 182°, 205°, and 210°.

Figure 7:
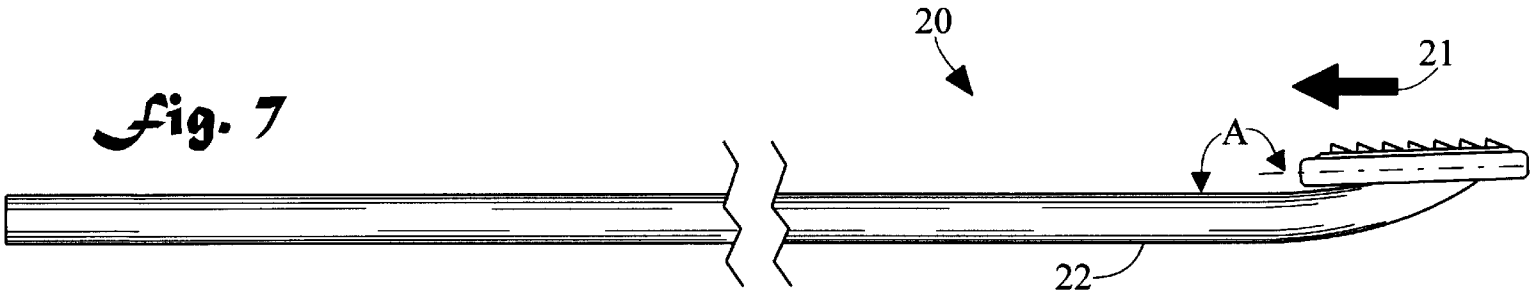
FIG. 7 is a fragmented side view of the tool showing a 178° shaft to rasp angle.

FIG. 7 is a fragmented side view of the dental tool 20 showing a 178° shaft to rasp angle A. This configuration is useful in filing relatively flat and easily accessible portions of the animal's teeth.

Figure 8:
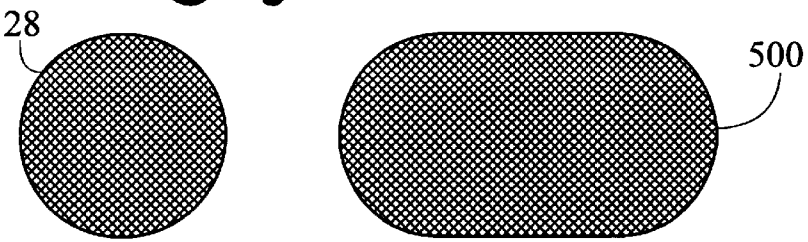
FIG. 8 is a simplified top plan view of the rasp of the present invention compared to a conventional rasp.

FIG. 8 is a simplified top plan view of rasp 28 of the present invention compared to a conventional longitudinally elongated rasp 500. The conventional rasp 500 has a much larger filing area and is therefore more likely to cause ancillary damage, such as to soft mouth tissue, during the filing process. Conversely, the circular shape of the present invention provides a concentrated filing area, is much easier to control, and is therefore less likely to occasion ancillary damage.

Figure 9:
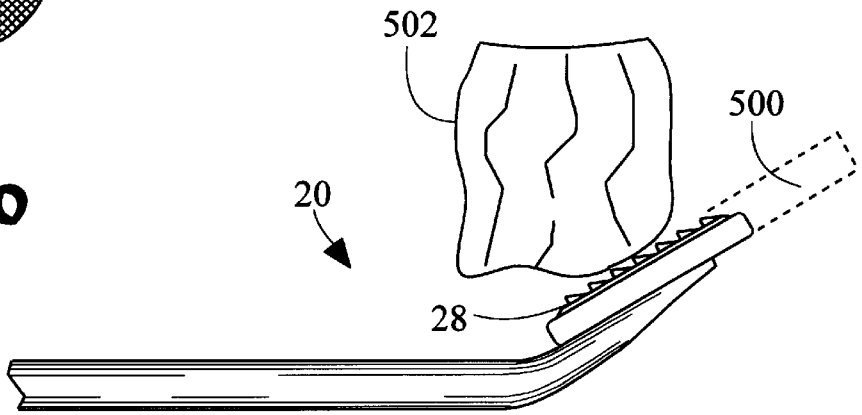
FIG. 9 is a fragmented side elevation view of the tool being used to file a rear tooth.

FIG. 9 is a fragmented side elevation view of dental tool 20 being used to file a rear tooth 502 of an animal. It is noted that a conventional rasp 500 extends much further into the animal's mouth, and is therefore much more likely to occasion damage to soft mouth tissue or bone.

Figure 10:
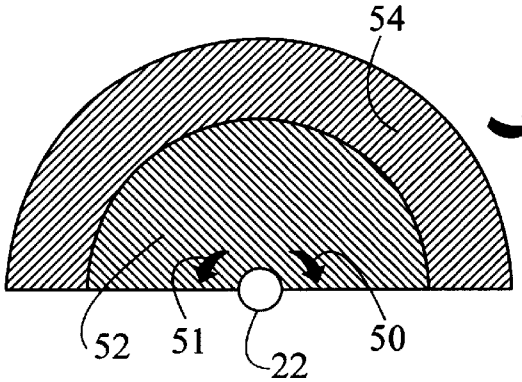
FIG. 10 is an end view of the elongated shaft showing the difference in rasp areas between the rasp of the present invention and a conventional rasp; and, FIG. 11 is a reduced side elevation view of the tool being used to file the teeth of a horse.

FIG. 10 is a second end 26 view of the elongated shaft 22 showing the difference in rasp areas between the rasp of the present invention 20 and a conventional rasp 500. As shaft 22 is rotated first in direction 50 and then in direction 51, as is often done during the filing process, the rasp of the present invention 20 sweeps out an area 52. However, a conventional rasp 500 would sweep out a much wider area 54, and therefore have a higher risk of causing damage to the soft mouth tissue or bone of the animal.

Figure 11:
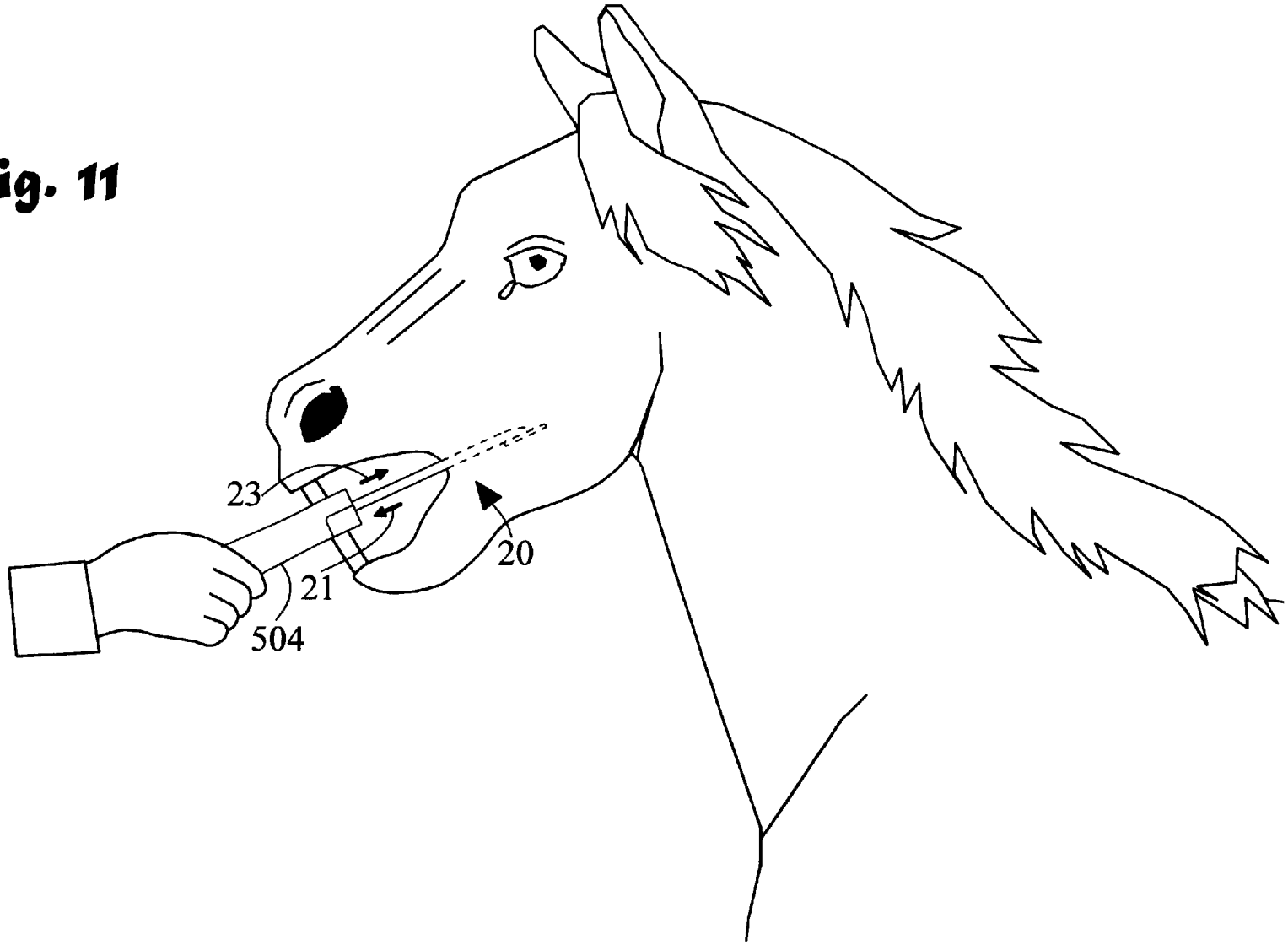

FIG. 11 is a reduced side elevation view of dental tool being used to file the teeth of a horse. Reciprocating mechanism 504 causes dental tool 20 to rapidly move back and forth in directions 21 and 23 to effect the filing process. Reciprocating mechanism 504 can be either electrically or pneumatically powered.

It is noted that while the present invention is designed specifically for filing the teeth of members of the equine species, it can of course be utilized on other animals as well.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A dental tool for animals such as the equine species, comprising:

an elongated shaft having a first end and an opposite second end;

a planar substantially circular rasp connected to said first end;

said rasp including a plurality of teeth, said teeth pointed toward said second end of said elongated shaft;

said rasp defining a plane; and, said plane forming an angle of between substantially 135° and 180° with said elongated shaft.

2. A dental tool according to claim 1, wherein said angle is between substantially 150° and 180°.

3. A dental tool according to claim 2, further including:

said angle being one of 178°, 155°, and 150°.

4. A dental tool for animals such as the equine species, comprising:

an elongated shaft having a first end and an opposite second end;

a planar substantially circular rasp connected to said first end;

said rasp including a plurality of teeth, said teeth pointed away from said second end of said elongated shaft;

said rasp defining a plane; and, said plane forming an angle of between substantially 180° and 225° with said elongated shaft.

5. A dental tool according to claim 4, wherein said angle is between substantially 180° and 210°.

6. A dental tool according to claim 5, further including:

said angle being one of 182°, 205°, and 210°.

7. A dental tool for animals such as the equine species, comprising:

an elongated shaft having a first end and an opposite second end;

a planar substantially circular rasp connected to said first end;

said first end having a substantially circular holder;

said rasp connected to said holder;

said rasp having a diameter of about one inch;

said rasp including a plurality of teeth, said teeth pointed toward said second end of said elongated shaft;

said rasp defining a plane; and, said plane forming an angle of between substantially 150° and 180° with said elongated shaft.

8. A dental tool for animals such as the equine species, comprising:

an elongated shaft having a first end and an opposite second end;

a planar substantially circular rasp connected to said first end;

said first end having a substantially circular holder;

said rasp connected to said holder;

said rasp having a diameter of about one inch;

said rasp including a plurality of teeth, said teeth pointed away from said second end of said elongated shaft;

said rasp defining a plane; and, said plane forming an angle of between substantially 180° and 210° with said elongated shaft.

* * * * *